US011573001B2

(12) United States Patent
Akin et al.

(10) Patent No.: US 11,573,001 B2
(45) Date of Patent: Feb. 7, 2023

(54) HEADLIGHT WITH AN AIR DUCT, HEADLIGHT UNIT, AND MOTOR VEHICLE

(71) Applicant: HELLA GmbH & Co. KGaA, Lippstadt (DE)

(72) Inventors: Hamza Akin, Lippstadt (DE); Vignesh Raju Chetty Shanmugam, Lippstadt (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 17/389,635

(22) Filed: Jul. 30, 2021

(65) Prior Publication Data

US 2022/0034476 A1 Feb. 3, 2022

(30) Foreign Application Priority Data

Jul. 30, 2020 (DE) ..... 10 2020 120 156.7

(51) Int. Cl.

| | |
|---|---|
| ***F21S 45/00*** | (2018.01) |
| ***F21S 45/49*** | (2018.01) |
| ***F21V 29/67*** | (2015.01) |
| ***F21S 45/42*** | (2018.01) |
| *F21W 107/10* | (2018.01) |

(52) U.S. Cl.

CPC ..... *F21S 45/49* (2018.01); *F21S 45/42* (2018.01); *F21V 29/67* (2015.01); *F21W 2107/10* (2018.01)

(58) Field of Classification Search

CPC .. F21S 45/40; F21S 45/42; F21S 45/47; F21S 45/48; F21S 45/49; F21S 45/30; F21V 29/67; F21V 29/677; F21V 29/51; F21V 29/60; F21V 29/02; F21W 2107/10

See application file for complete search history.

(56) References Cited

U.S. PATENT DOCUMENTS

| | | | | |
|---|---|---|---|---|
| 7,329,033 | B2 | 2/2008 | Glovatsky et al. | |
| 2007/0091632 | A1* | 4/2007 | Glovatsky | F21V 29/70 362/373 |
| 2007/0121336 | A1* | 5/2007 | Chinniah | F21S 45/48 362/507 |
| 2011/0051453 | A1* | 3/2011 | Nagasawa | F21V 29/67 362/547 |

FOREIGN PATENT DOCUMENTS

| | | | |
|---|---|---|---|
| DE | 102004025624 | A1 | 12/2005 |
| DE | 102006051030 | A1 | 5/2007 |
| DE | 102007057056 | A1 | 5/2009 |
| JP | 2006294263 | A | 10/2006 |

* cited by examiner

*Primary Examiner* — Y M. Quach Lee
(74) *Attorney, Agent, or Firm* — Muncy, Geissler, Olds & Lowe, P.C.

(57) ABSTRACT

A headlight for a motor vehicle, the headlight having a housing, at least one light module in the housing for emitting light from the housing, an air duct with a longitudinal extent, and at least one fan for conducting air through the air duct, wherein the air duct is formed partly from an air guiding element, disposed inside housing, and partly from an outer wall of the housing. Further, a headlight unit and a motor vehicle are provided.

19 Claims, 3 Drawing Sheets

HEADLIGHT WITH AN AIR DUCT, HEADLIGHT UNIT, AND MOTOR VEHICLE

This nonprovisional application claims priority under 35 U.S.C. § 119(a) to German Patent Application No. 10 2020 120 156.7, which was filed in Germany on Jul. 30, 2020, and which is herein incorporated by reference.

BACKGROUND OF THE INVENTION

Field of the Invention

The present invention relates to a headlight for a motor vehicle having a housing, at least one light module in the housing for emitting light from the housing, an air duct, and at least one fan for conducting air through the air duct. The present invention further relates to a headlight unit with a headlight and with a cooling element and to a motor vehicle with at least one headlight and/or at least one headlight unit.

Description of the Background Art

Light modules and other components in headlights require cooling to ensure their function and their service life. In known headlights, the cooling, in particular the air flow in the headlight housing, includes a large number of molded parts, which are usually fully assembled as a subassembly to form a cooling duct and are installed together in a headlight housing. The known cooling systems mostly run completely within the headlight housing and, in order to prevent dirt in the headlight housing, do not have any air exchange with the surroundings of the headlight. The known cooling systems mostly only provide a circulation of the air in the headlight housings. The guidance of the air is usually ensured completely by said subassembly formed of a large number of molded parts, the subassembly being disposed and secured on and in the headlight. Cooling of the circulating air in the headlight is not provided in the known cooling systems for headlights for motor vehicles.

The known cooling systems for headlights for motor vehicles therefore have the common disadvantages of the lack of and/or insufficient cooling of the air in the headlight housing and a high outlay of materials and costs for the design of the cooling ducts.

SUMMARY OF THE INVENTION

It is therefore an object of the present invention to provide a headlight for a motor vehicle, a headlight unit, and a motor vehicle which at least partially overcome the above disadvantages. Further, it is in particular the object of the present invention to improve the cooling of the air in a headlight housing and/or to reduce the outlay of materials and costs for a headlight housing.

According to an exemplary embodiment, the object is achieved by a headlight for a motor vehicle. The headlight has a housing, at least one light module in the housing for emitting light from the housing, an air duct with a longitudinal extent, and at least one fan for conducting air through the air duct. The air duct is formed partly from an air guiding element, disposed inside the housing, and partly from an outer wall of the housing. In order to emit light from the housing, the housing preferably has a transparent section, for example, made of glass. The air duct is preferably designed at least in sections, particularly preferably completely, along the longitudinal extent of the air duct, from the housing, in particular the outer wall of the housing, and from the air guiding element together. The air duct is preferably designed closed in its circumference. For this purpose, the air guiding element is preferably disposed and/or secured on the housing, in particular the outer wall of the housing, in a form-fitting manner. The air guiding element is also preferably formed with thin walls. The headlight is preferably secured and/or sealed against air infiltration from outside the housing and/or against other environmental influences. The air guiding element advantageously together with the housing enables air circulation in the headlight housing and the invention preferably provides no or substantially no air exchange with the surroundings of the headlight. The wording "X or substantially X" should be understood within the scope of the invention as a possible, slight deviation, for example, due to manufacturing tolerances and/or material properties, without changing the underlying, intended function of the feature. By designing the air duct partly from the air guiding element, disposed inside the housing, and partly from the outer wall of the housing, a temperature exchange of the air in the air duct through the outer wall of the housing with, for example, the air surrounding the headlight is made possible. A direct heat sink between the air in the air duct and, for example, the air surrounding the headlight is made possible by the outer wall of the housing. Further, the design of the air duct partly from the air guiding element, disposed inside the housing, and partly from the outer wall of the housing enables material and cost savings compared to an entirely formed cooling duct that is only disposed and/or secured on the housing of the headlight. A headlight of the invention is particularly advantageous because the structural design of the air duct improves cooling of the air in the headlight housing and reduces the outlay of materials and costs for the air duct. The light module preferably has a cooling element for cooling the light module. The longitudinal extent of the air duct is to be understood in the context of the invention as an extent along or substantially along the flow guidance of the air through the air duct and/or headlight. The air guiding element can, for example, be screwed, clipped, glued, plugged, clamped, and/or otherwise disposed and/or secured on the housing.

The air guiding element can be designed in one piece and/or monolithically, in particular in one piece and/or monolithically with the housing. A structural design of the air guiding element from only a one-piece and/or monolithic component is particularly advantageous, because the air duct is thus designed as one component only from the housing and said air guiding element. Thus, the preferred refinement of the invention can save material costs and effort for assembly as well as installation space for the structural design. Alternatively or in addition, even a one-piece and/or monolithic design of the air guiding element with the housing is provided, so that the air duct is provided and manufactured directly, for example, when the headlight housing is manufactured, and thus additional material costs and effort for assembly and installation space for the structural design can be saved.

The housing can have a smaller wall thickness in one area of the air duct than a wall thickness in at least one other area, in particular in the remaining areas of the housing. The housing can have a plurality of different wall thicknesses. In one area of the air duct, the housing preferably has an outer wall with a smaller wall thickness than the remaining areas of the outer wall of the housing. A smaller wall thickness in the area of the air duct enables an improved heat transfer from the air in the air duct to the surroundings of the headlight and thus an improved cooling of the headlight. The heat sink through the outer wall of the housing is improved by the lower wall thickness in one area of the air duct, wherein the greater wall thickness in the remaining areas of the outer wall of the housing enables and/or ensures the structural stability of the headlight. The area of the housing and/or the outer wall in an area of the air duct should be understood in the context of the invention, for example, as the part of the air duct that is formed by the outer wall of the housing. The area of the housing and/or the outer wall of the housing can completely or partially have the smaller wall thickness.

The air guiding element can have at least one air exit opening along the longitudinal extent of the air duct. Air exit openings along the longitudinal extent of the air duct advantageously allow the selective air guidance and/or inflow to areas in the headlight, for example, the light module and/or a cooling element in the headlight. The air exit openings enable at least part of the air in the air duct to flow out of the air duct through the air exit opening into the interior of the headlight. A headlight designed in this way is particularly advantageous because the at least one air exit opening enables selective air guidance and/or inflow and thus an improved cooling of the headlight.

The at least one fan can be disposed at an end face of the air duct and/or in the air duct. The headlight of the invention preferably provides an axial fan. In addition, a fan can be disposed and/or secured on and/or in both and/or in each end face of the air duct. The at least one fan is preferably disposed and/or secured on the housing and/or the air guiding element with at least one securing device for the fan. Further, the headlight of the invention preferably provides a sealing device between the at least one fan and the housing and/or the air guiding element and/or an anti-vibration device between the at least one fan and the housing and/or the air guiding element. A headlight designed in this manner is particularly advantageous because advantageous cooling and fluid mechanics in the headlight are made possible by the arrangement of the at least one fan.

The outer wall of the housing, in particular in the area of the air duct, can have an enlarged surface. An enlarged surface for improved temperature transfer from the housing to the surroundings of the headlight is preferably formed on the outer side of the outer wall of the housing. In addition or alternatively, an enlarged surface for improved temperature transfer from the air duct to the housing is preferably formed on the inner side of the outer wall of the housing. An enlarged surface of the outer wall of the housing, in particular in the area of the air duct, can be made possible, for example, by a rib structure of the outer wall, by a curved, wavy, and/or serrated design of the outer wall and/or by a different design of the outer wall. An exemplary bulging of the outer wall of the housing enables a preferred air duct design. The bulge protrudes, for example, out of the remaining volume of the housing. A headlight designed in this manner advantageously enables an improvement of the cooling with simple and inexpensive means.

The headlight can have at least one air guiding body in the air duct, in particular wherein the at least one air guiding body is disposed and/or secured on an inner side of the housing and/or on an inner side of the air guiding element. An air guiding body can be understood, for example, as a guide plate, a flow guide, a guide vane, and/or as a scoop in the air duct. The at least one air guiding body makes it possible to redirect selectively at least part of the air in the air duct and, for example, to have it flow out of the air duct through an air exit opening described above into the interior of the headlight. A headlight designed in this manner is particularly advantageous because the at least one air guiding body enables a selective air guidance and/or inflow and thus an improved cooling of the headlight.

The air guiding element can be designed as a first half shell of the air duct and/or the housing in the area of the air duct is designed as a second half shell of the air duct. The design of the air duct from two half shells, which are formed by the air guiding element and the housing in the area of the air duct, enables an advantageous flow guidance and/or cooling of the headlight. The design as half shells further enables an advantageous stability of the components and of the air duct. The half shells, in particular on the inner side, can be preferably designed round and/or rounded in order to enable an advantageous flow guidance.

The air duct can be disposed on a rear side or substantially on a rear side, along a main extent of the headlight or substantially along a main extent, and/or on at least two sides of the housing. An arrangement of the air duct on a rear side, along a main extent of the headlight and/or on at least two sides of the housing represents a particularly advantageous embodiment of the headlight of the invention, because this advantageously enables particularly advantageous cooling of the headlight and/or air flow through the headlight. The air duct therefore preferably has at least one angular redirection of the flow in the air duct. The rear side of the headlight can be understood in the context of the invention as the side that faces away from the emission and/or the emission direction of light from the light module. In other words, when the headlight is installed as a front headlight in a motor vehicle, the rear side of the headlight faces away from the direction of travel of the motor vehicle.

The air duct can have at least one air inlet opening at a first end face of the air duct and at least one air outlet opening at a second end face of the air duct, in particular wherein the headlight comprises a recirculation device in the area of the air outlet opening. The design of the air duct with at least one air inlet opening at a first end face of the air duct and at least one air outlet opening at a second end face represents a preferred design of the headlight of the invention, because it enables a selective flow guidance. The advantageous addition of a recirculation device in the area of the air outlet opening preferably enables a redirection of the air, cooled in the air duct, in the area of the air outlet opening back into the area of the air inlet opening and/or the remaining area of the headlight and thus an advantageously improved flow guidance and cooling of the headlight. A recirculation device can be designed as a guide plate, housing structure, vane, and/or as some other recirculation device.

The air duct can be divided, at least in areas, into at least two air subducts. A preferably parallel configuration of at least two air subducts provides an advantageous flow guide in the headlight of the invention, because the absorption and release of heat by the air in the air duct and in particular in the air subduct can be specifically controlled. A controlled influencing of the temperatures and cooling in the headlight is thus made possible. The air subducts can be designed over sections of the air duct or over the entire length. The air subducts can have common or separate air inlet openings and air outlet openings. A plurality of air subducts with a preferably common heat sink are thus preferably made possible via the outer wall of the housing.

The outer wall of the housing in the area of the air duct can have a material with an increased thermal conductivity relative to a material of the rest of the housing. A material with an increased thermal conductivity relative to a material of the rest of the housing advantageously improves the heat sink via the outer wall of the housing. The headlight housing can be made of a plastic, for example, whereas the outer wall of the housing in the area of the air duct has at least in sections a material with an increased thermal conductivity relative to the base material of the housing, for example, copper, metal, and/or another plastic. Thus, improved cooling of the air in the air duct is made possible by the material with an increased thermal conductivity on the outer wall of the housing in the area of the air duct.

The outer wall of the housing, in particular in the area of the air duct, can have a cooling element interface. In the context of the invention, a cooling element interface represents an interface of the headlight for the thermally operatively connected connection of a cooling element. In a simple embodiment, a cooling element interface can be the outer side of the housing in the area of the air duct. The cooling element interface preferably has an increased thermal conductivity, securing device, and/or an at least partially flat surface for the thermally operatively connected connection of a cooling element. The possibility of connecting a cooling element to the cooling element interface of the headlight represents an advantageous refinement of the headlight of the invention, because the cooling capacity of the air duct can thus be adjusted in a controlled manner and/or preferably increased by a cooling element.

The object is also achieved by a headlight unit, wherein the headlight unit has a headlight and a cooling element and the headlight is designed according to the first aspect of the invention, in particular wherein the cooling element comprises a fluid channel and/or a heat sink. The headlight unit also has the mentioned advantages, as already described above with regard to the headlight of the invention. The cooling element, in particular the heat dissipation of the cooling element, can be designed to be active or passive. The cooling element is preferably disposed and/or secured on the described cooling element interface of the headlight. In the context of the invention, the cooling element serves to improve the dissipation of heat from the headlight, in particular from the air duct, via the outer wall of the housing. A headlight unit designed in this way is particularly advantageous because cooling of the headlight is improved using simple and inexpensive means and the structural design of the air duct and the cooling element improves the cooling of the air in the headlight housing and reduces the outlay of materials and costs for the air duct.

The object is also achieved by a motor vehicle, wherein the motor vehicle has at least one headlight and/or at least one headlight unit and the headlight is designed according to the first aspect of the invention and/or the headlight unit is designed according to the second aspect of the invention. The vehicle also has the mentioned advantages, as already described above with regard to the headlight of the invention and the headlight unit of the invention. A motor vehicle designed in this way is particularly advantageous because cooling of the air in the headlight housing is improved with simple and inexpensive means and/or the outlay of materials and costs for the structural design of the air duct is reduced.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
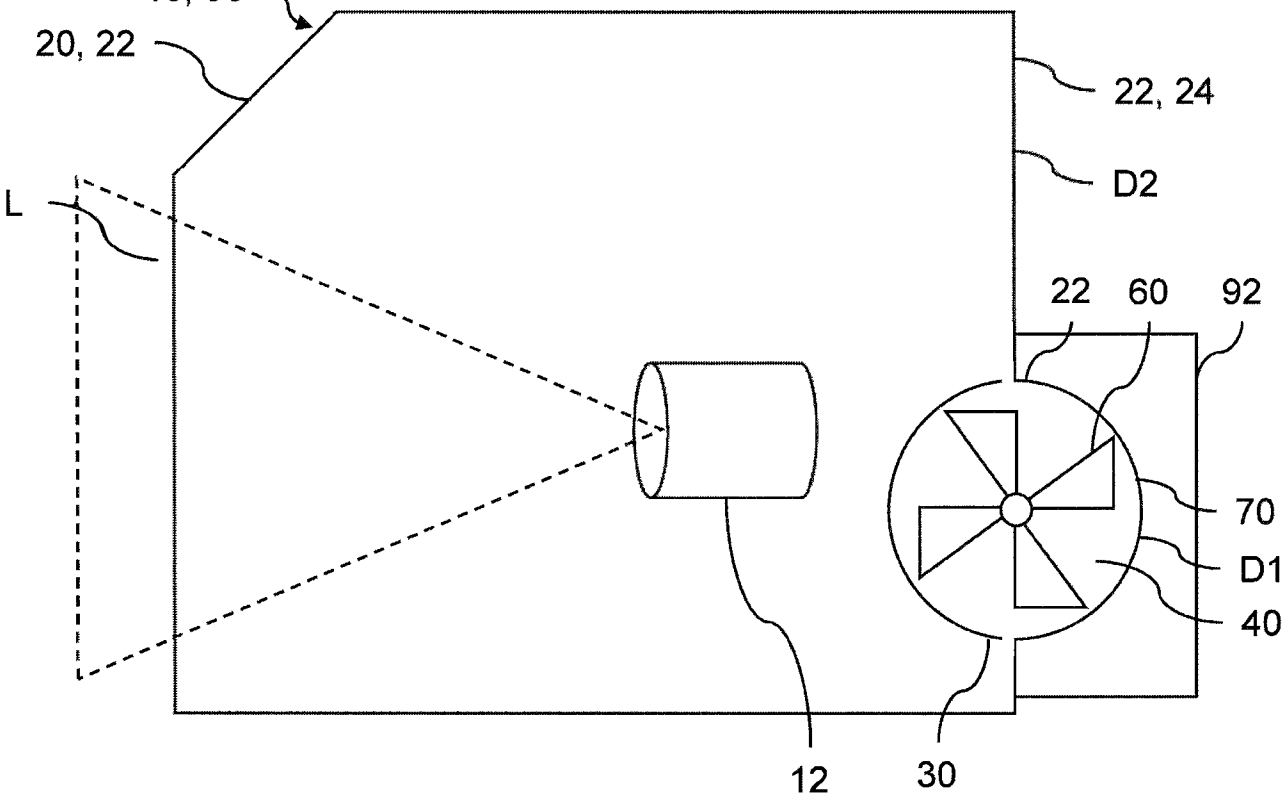
FIG. 1 shows in a side view a headlight unit with a headlight and a cooling element.

FIG. 1 shows in a side view a headlight unit 90 with a headlight 10 for a motor vehicle 100 and a cooling element 92. Headlight 10 has a housing 20, a light module 12 in housing 20 for emitting light L from housing 20, an air duct 40, and a fan 60 for conducting air through air duct 40. Air duct 40 is formed partly from an air guiding element 30, disposed inside housing 20, and partly from an outer wall 22 of housing 20. Air guiding element 30 is shown spaced apart from housing 20 for better illustration. However, air guiding element 30 is preferably disposed in a form-fitting manner on housing 20 and/or connected thereto. Housing 20, in particular outer wall 22 of housing 20, has a smaller wall thickness D1 in one area of air duct 40 than a wall thickness D2 in at least one other area, in particular in the remaining areas of outer wall 22 of housing 20. Air guiding element 30 is designed in one piece and monolithically as a first half shell of air duct 40. Outer wall 22 of housing 20 has an enlarged surface in the area of air duct 40 due to an outwardly curved design as a second half shell and thus enables an improved heat transfer to the surroundings of headlight 10. Here, the enlarged surface enables an improved heat transfer to cooling element 92 disposed and secured on cooling element interface 70. Air duct 40 is disposed on a rear side 22 of headlight 10 and enables a design of headlight 10 that is advantageous in terms of installation space. The headlight of the invention 10 is particularly advantageous because the structural design of air duct 40 improves the cooling of the air in housing 20 and reduces the outlay of materials and costs for air duct 40.

Figure 2:
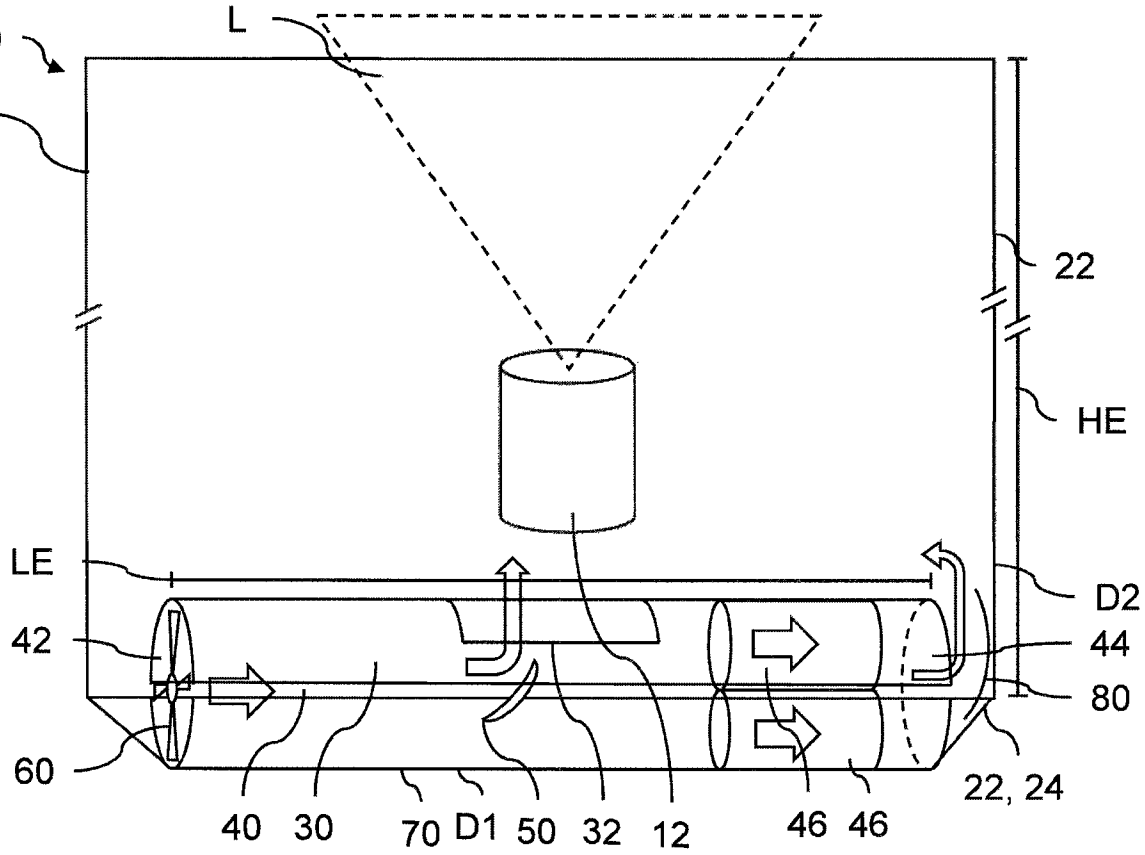
FIG. 2 shows in a top plan view a headlight.

FIG. 2 shows a top plan view of a headlight 10 with an air duct 40. Air duct 40 comprises a fan 60 which is disposed at an end face of air duct 40. Air guiding element 30 has an air exit opening 32 along the longitudinal extent LE of air duct 40. Air exit opening 32 enables at least part of the air in air duct 40 to flow out of air duct 40 through air exit opening 32 into the interior of headlight 10. Headlight 10 further comprises an air guiding body 50 in air duct 40, wherein air guiding body 50 is disposed and secured on an inner side of housing 20 and on an inner side of air guiding element 30. A headlight 10 designed in this manner is particularly advantageous because air exit opening 32 and air guiding body 50 enable a selective air guidance and/or inflow and thus improved cooling of headlight 10. Air duct 40 has an air inlet opening 42 at a first end face of air duct 40 and an air outlet opening 44 at a second end face of air duct 40, wherein headlight 10 further comprises a recirculation device 80 in the area of air outlet opening 44. Air duct 40 is divided in areas into two air subducts 46. Air duct 40 in FIG. 2 is disposed on a rear side 24, transversely to a main extent HE of headlight 10 and only on one side of housing 20.

Figure 3:
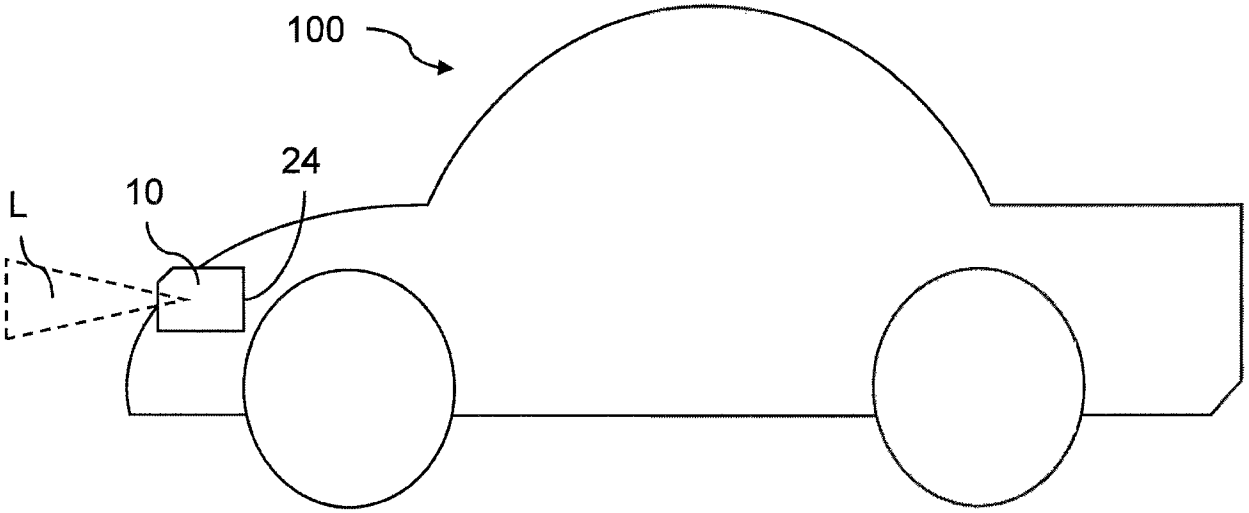
FIG. 3 shows in a side view a motor vehicle with two headlights.

FIG. 3 shows a motor vehicle 100 in a side view. Motor vehicle 100 has two headlights 10, which are mounted as front headlights, only one headlight 10 being visible due to the perspective of FIG. 3. A motor vehicle 100 designed in this way is particularly advantageous because cooling of the air in housing 20 of headlight 10 is improved with simple and inexpensive means and/or an outlay of materials and costs for the structural design of air duct 40 is reduced.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A headlight for a motor vehicle, the headlight comprising:

a housing;

at least one light module arranged in the housing for emitting light from the housing;

an air duct with a longitudinal extent; and at least one fan to conduct air through the air duct, wherein the air duct is formed partly from an air guiding element disposed inside the housing and partly from an outer wall of the housing, and wherein the outer wall of the housing is outwardly curved with an enlarged surface in an area of the air duct.

2. The headlight according to claim 1, wherein the air guiding element is designed in one piece and/or monolithically, in particular in one piece and/or monolithically with the housing.

3. The headlight according to claim 1, wherein the housing has a smaller wall thickness in one area of the air duct than a wall thickness in at least one other area or in remaining areas of the housing.

4. The headlight according to claim 1, wherein the air guiding element has at least an air exit opening along the longitudinal extent of the air duct.

5. The headlight according to claim 1, wherein the at least one fan is disposed at an end face of the air duct and/or in the air duct.

6. The headlight according to claim 1, wherein the outer wall of the housing in an area of the air duct, has an enlarged surface.

7. The headlight according to claim 1, wherein the headlight has at least one air guiding body in the air duct, and wherein the at least one air guiding body is disposed and/or secured on an inner side of the housing and/or on an inner side of the air guiding element.

8. The headlight according to claim 1, wherein the air duct is disposed on a rear side along a main extent of the headlight and/or on at least two sides of the housing.

9. The headlight according to claim 1, wherein the air duct is divided, at least in sections, into at least two air subducts.

10. The headlight according to claim 1, wherein the outer wall of the housing in an area of the air duct has a material with an increased thermal conductivity relative to a material of the rest of the housing.

11. The headlight according to claim 1, wherein the outer wall of the housing in an area of the air duct, has a cooling element interface.

12. A headlight unit comprising:

a headlight according to claim 11; and a cooling element comprising a fluid channel and/or a heat sink.

13. A motor vehicle comprising at least one headlight according to claim 1.

14. A motor vehicle comprising at least one headlight unit according to claim 12.

15. The headlight according to claim 1, wherein the air duct has an air inlet opening at a first end face of the air duct and an air outlet opening at a second end face of the air duct.

16. A headlight for a motor vehicle, the headlight comprising:

a housing;

at least one light module arranged in the housing for emitting light from the housing;

an air duct with a longitudinal extent; and at least one fan to conduct air through the air duct, wherein the air duct is formed partly from an air guiding element disposed inside the housing and partly from an outer wall of the housing, and wherein the air guiding element is designed as a first half shell of the air duct and/or the housing in the area of the air duct is designed as a second half shell of the air duct.

17. A headlight for a motor vehicle, the headlight comprising:

a housing;

at least one light module arranged in the housing for emitting light from the housing;

an air duct with a longitudinal extent; and at least one fan to conduct air through the air duct, wherein the air duct is formed partly from an air guiding element disposed inside the housing and partly from an outer wall of the housing, wherein the air duct has at least one air inlet opening at a first end face of the air duct and at least one air outlet opening at a second end face of the air duct, and wherein the headlight comprises a recirculation device in an area of the air outlet opening.

18. A headlight for a motor vehicle, the headlight comprising:

a housing;

at least one light module arranged in the housing for emitting light from the housing;

an air duct with a longitudinal extent;

at least one fan to conduct air through the air duct; and a recirculation device in an air outlet opening of the air duct, wherein the air duct is formed partly from an air guiding element disposed inside the housing and partly from an outer wall of the housing.

19. A headlight for a motor vehicle, the headlight comprising:

a housing having an outer wall;

a light module arranged in the housing;

an air guiding element disposed inside the housing; and a fan configured to conduct air through the air duct, wherein the air guiding element and the housing form an air duct, and wherein the outer wall of the housing is outwardly curved with an enlarged surface in an area of the air duct.

* * * * *